US009180568B2

(12) United States Patent
Sroka et al.

(10) Patent No.: US 9,180,568 B2
(45) Date of Patent: Nov. 10, 2015

(54) METHOD FOR INSPECTING AND REFURBISHING ENGINEERING COMPONENTS

(75) Inventors: Gary Sroka, Missouri City, TX (US); Lane W. Winkelmann, New Ulm, TX (US); Mark D. Michaud, Austin, TX (US)

(73) Assignee: REM Technologies, Inc., Brenham, TX (US)

( * ) Notice: Subject to any disclaimer, the term of this patent is extended or adjusted under 35 U.S.C. 154(b) by 338 days.

(21) Appl. No.: 12/675,712

(22) PCT Filed: Aug. 28, 2008

(86) PCT No.: PCT/US2008/010286

§ 371 (c)(1),
(2), (4) Date: Feb. 26, 2010

(87) PCT Pub. No.: WO2009/032221

PCT Pub. Date: Mar. 12, 2009

(65) Prior Publication Data

US 2010/0233510 A1 Sep. 16, 2010

Related U.S. Application Data

(60) Provisional application No. 60/966,417, filed on Aug. 28, 2007.

(51) Int. Cl.
*B24B 31/00* (2006.01)
*B24B 5/00* (2006.01)

(52) U.S. Cl.
CPC . *B24B 5/00* (2013.01); *B24B 31/00* (2013.01); *Y10T 428/12993* (2015.01)

(58) Field of Classification Search
CPC ..... B24B 31/14; B24B 31/02; B24B 31/00; B24B 31/073; B24B 9/107
USPC ..... 451/8, 59, 32, 34, 35, 326, 328, 330
See application file for complete search history.

(56) References Cited

U.S. PATENT DOCUMENTS 3,147,654 A * 9/1964 Engel ..... 82/107
3,641,716 A * 2/1972 Price ..... 451/415

(Continued)

FOREIGN PATENT DOCUMENTS

EP 1 286 020 A2 2/2003
EP 1 561 542 A1 8/2005

(Continued)

OTHER PUBLICATIONS

Alexander, Bearing Repair Provides Valuable Alternative to Bearing Replacement for Heavy Industries, (Power Transmission Engineering, V. 2, No. 4, Elk Grove Village, IL, Aug. 2008, pp. 42-47).

(Continued)

*Primary Examiner* — George Nguyen
(74) *Attorney, Agent, or Firm* — Jones Walker LLP

(57) ABSTRACT

Refurbishing used or damaged engineering components is performed using a subtractive surface engineering process to remove material from worn or damaged critical surfaces. The method involves initially performing the process on the component to remove a first quantity of material from the surfaces, inspecting the surface of the component to determine the extent of damage and subsequently further performing the process to remove a further quantity of material if necessary.

28 Claims, 3 Drawing Sheets

(56) References Cited

U.S. PATENT DOCUMENTS

| | | | | | |
|---|---|---|---|---|---|
| 3,751,861 | A | | 8/1973 | Frost et al. | |
| 3,837,122 | A | * | 9/1974 | Ferguson | 451/160 |
| 3,979,858 | A | * | 9/1976 | Semones et al. | 451/35 |
| 3,999,331 | A | * | 12/1976 | Trujillo | 451/439 |
| 4,016,683 | A | * | 4/1977 | Cretella | 451/305 |
| 4,118,896 | A | * | 10/1978 | Walther et al. | 451/327 |
| 4,309,848 | A | * | 1/1982 | Arrigoni | 451/296 |
| 4,449,330 | A | * | 5/1984 | McCarthy et al. | 451/28 |
| 4,491,500 | A | * | 1/1985 | Michaud et al. | 216/87 |
| H244 | H | * | 4/1987 | Goodwin | 451/57 |
| 4,660,326 | A | * | 4/1987 | Petkov et al. | 451/113 |
| 5,271,184 | A | * | 12/1993 | Majors | 451/113 |
| 5,507,685 | A | * | 4/1996 | Hoffman | 451/34 |
| 5,733,172 | A | * | 3/1998 | Nishimura et al. | 451/32 |
| 5,743,789 | A | * | 4/1998 | Russell | 451/57 |
| 5,803,800 | A | * | 9/1998 | Kobayashi et al. | 451/326 |
| 5,873,770 | A | * | 2/1999 | Hashimoto | 451/32 |
| 6,149,506 | A | * | 11/2000 | Duescher | 451/59 |
| 6,220,947 | B1 | | 4/2001 | Wheat et al. | |
| 6,732,606 | B1 | * | 5/2004 | Zhu et al. | 74/460 |
| 6,910,948 | B2 | * | 6/2005 | Yoshiba et al. | 451/35 |
| 6,966,820 | B1 | * | 11/2005 | Lyons et al. | 451/36 |
| 7,140,947 | B2 | * | 11/2006 | Nishimura et al. | 451/10 |
| 7,258,833 | B2 | * | 8/2007 | Rainey et al. | 419/18 |
| 7,335,089 | B1 | * | 2/2008 | Thompson | 451/38 |
| 8,062,094 | B2 | * | 11/2011 | Cisek et al. | 451/33 |
| 8,171,637 | B2 | * | 5/2012 | Michaud et al. | 29/893.3 |
| 2001/0007807 | A1 | * | 7/2001 | Wheat et al. | 451/32 |
| 2003/0037436 | A1 | | 2/2003 | Duicotey, Jr. et al. | |
| 2005/0014597 | A1 | * | 1/2005 | Michaud et al. | 475/344 |
| 2006/0116053 | A1 | * | 6/2006 | Nishimura et al. | 451/32 |
| 2006/0276355 | A1 | * | 12/2006 | Carey et al. | 508/485 |
| 2007/0037492 | A1 | * | 2/2007 | Hood et al. | 451/54 |
| 2008/0104842 | A1 | * | 5/2008 | Michaud et al. | 29/893.3 |
| 2008/0108470 | A1 | * | 5/2008 | Michaud et al. | 475/159 |
| 2008/0196793 | A1 | * | 8/2008 | Winkelmann | 148/274 |
| 2008/0197112 | A1 | * | 8/2008 | Wang et al. | 216/89 |
| 2009/0107275 | A1 | * | 4/2009 | Cooper et al. | 74/462 |
| 2013/0260647 | A1 | * | 10/2013 | Kosiorek | 451/28 |

FOREIGN PATENT DOCUMENTS

| | | | |
|---|---|---|---|
| JP | 2003-155935 | A | 5/2003 |
| JP | 2003172364 | A | 6/2003 |
| JP | 2005226683 | A | 8/2005 |
| WO | WO 2004/108356 | A1 | 12/2004 |

OTHER PUBLICATIONS

Engineers Edge, Specifying AGMA Spur Gear, Helical Gear, and Herringbone Gear Backlash, http://www.engineersedge.com/gears/determining_gear_backlash.htm Aug. 25, 2008.

Felker, Isotrophic Superfinishing (ISF) for CH-47 Horizontal Hinge Pins.

McNiff, et al, Documenting the Progression of Gear Micropitting in the NREL Dynamometer Test Facility (American Wind Energy Association, AWEA 2002, Washington, D.C., Jun. 3, 2002, pp. 1-5).

Meyer, et al, Gear Refurbishment, An Economical Approach for Aerospace Overhaul & Repair (American Gear Manufacturers Association, 98FTM12. Alexandria, VA, USA, Oct. 1998).

European Patent Application No. 08 795 724.7—2302 Communication Pursuant to Article 94(3) EPC dated Sep. 24, 2012.

Yoshioka, Yomei, Coating Repair and Preventive Maintenance Technique, Journal of Gas Turbine Society of Japan, Nov. 20, 2002, vol. 30, No. 3, pp. 510-513.

Japanese Patent Application No. 2010-522972, English Translation of Office Action with a Mailing Date of Apr. 9, 2013.

Japanese Patent Application No. 2010-522972, non-certified English Translation of Office Action dated Mar. 18, 2014.

* cited by examiner

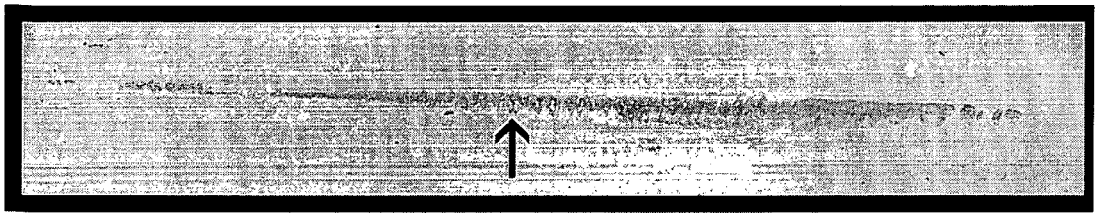
Fig 1.A
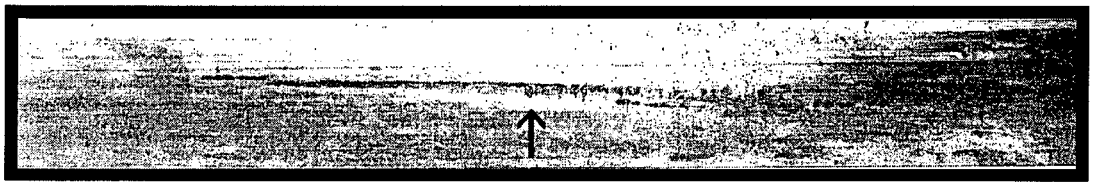
Fig 1.B
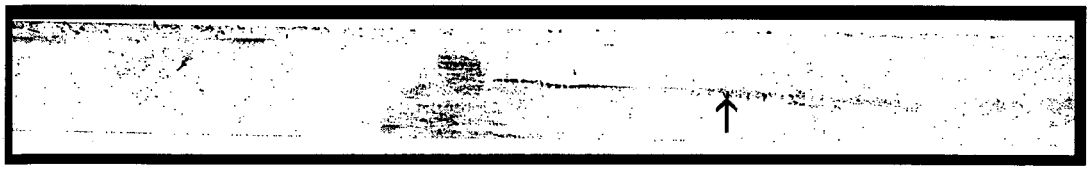
Fig 1.C
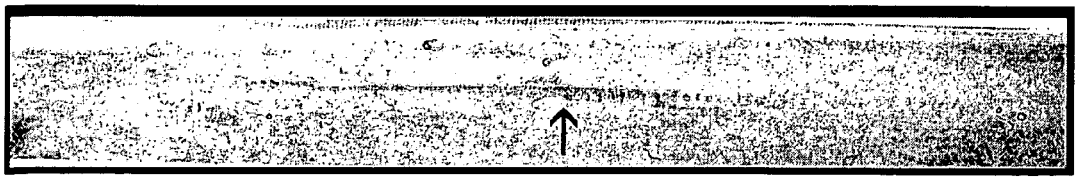
Fig 1.D

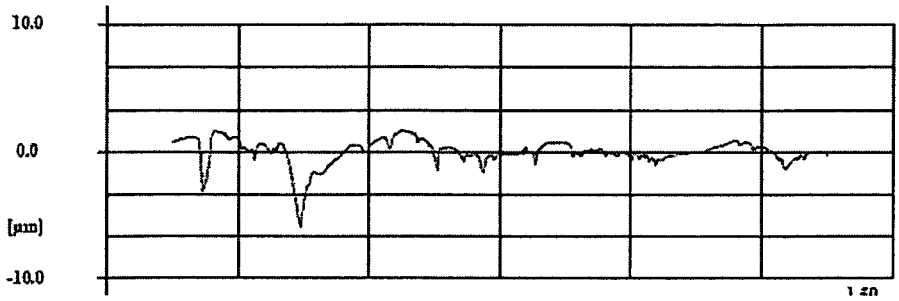
Fig 3.A
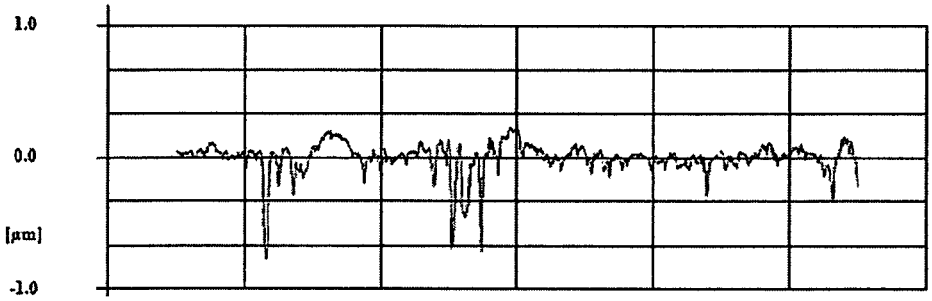
Fig 3.B

METHOD FOR INSPECTING AND REFURBISHING ENGINEERING COMPONENTS

CROSS REFERENCE TO RELATED APPLICATIONS

This application claims priority from U.S. Provisional application No. 60/966,417 filed on 28 Aug. 2007, the contents of which are hereby incorporated by reference in their entirety.

BACKGROUND OF THE INVENTION

1. Field of the Invention

The invention relates generally to methods of refurbishing or restoring metal components back to an acceptable operational condition using subtractive surface engineering techniques that maintain the component within geometrical tolerance. The method is particularly applicable to components manufactured or finished to tight tolerances that are used in metal to metal contact mechanisms and where the original manufacturing geometric specification may be absent or unavailable. The method further relates to a method of assessment of such components for refurbishment and the refurbished products thereof.

2. Description of the Related Art

Used, worn or damaged high value metal components and new components damaged during storage, handling, assembly or transportation, including cam shafts, crank shafts, bearings, gears and the like, can sometimes be refurbished by regrinding or re-machining (e.g. milling, lathing and the like) the component's critical used surfaces. If the operation is successful, the component may be put back into service at less cost than would have been the case were the component replaced by a new part. In order to do this, however, the machinist must have a copy of the component's Engineering Specification Drawing (ESD) or equivalent specification sheet to be able to correctly refurbish the critical surfaces. The ESD will contain information such as all dimensions used to originally manufacturer the component, the tolerances on all dimensions, the component's material and heat treatment, and the like. This information is needed to allow the machinist to correctly regrind or re-machine the component's critical surfaces and to inspect the results.

Also, often complex and expensive Component Specific Tooling (CST) is required to fixture the metal component for any regrinding or re-machining operation and/or component specific inspections. The machinist must have a set of this CST, or be able to manufacture suitable tooling to fixture and/or inspect the component.

Since the refurbishment is often done at a facility other than that of the Original Equipment Manufacturer (OEM), the ESD and/or CST are likely to be unavailable and probably unattainable from the OEM. In fact many OEMs do not make their ESDs available to third parties. In all likelihood then, these components would be scrapped at great expense. In many cases, replacement components are no longer manufactured or require a long lead time to purchase. This can lead to costly lost machine availability or to the premature retirement of the entire machine from which the used component came.

In addition, even if the ESD and CST are available, a considerable amount of manpower and expensive equipment is needed in setting up and carrying out the regrinding or re-machining process. For just one individual item, the cost of re-machining may not justify the effort required. This is often the case if a single machine is overhauled; a small number of different components with varying shapes and sizes will need to be refurbished. The cost of refurbishment by a regrinding or re-machining process may very well be too expensive to be commercially viable.

An additional problem is that of retaining the original tolerances. In certain circumstances, regrinding may remove so much material that the component becomes undersized. This cannot always be determined prior to commencing work and the high levels of scrap in such processes considerably increase the overall cost of the work. Usually a regrinding operation will comprise setting up and aligning the component in the grinder or lathe, performing a first pass, inspecting and adjusting the alignment of the component and performing a further pass to remove the desired quantity of material. Sometimes, a number of passes may be required merely to achieve correct alignment. In certain processes, the minimum amount of material that can be effectively ground in a single pass is 10-20 microns. If three passes are required to complete the component, as much as 60 microns may have been removed. For e.g. a gear tooth in which material has been removed from both faces of the tooth, a total dimensional change of 120 microns may result.

An additional problem is that these refurbishing methods can result in surface material movement, deformation, impregnation, tearing, smearing and/or metal overlapping. These forms of material distress hereinafter referred to as "surface distortion" can mask the effectiveness of inspection techniques such that the surface damage cannot be identified and the component could be put back into service without having been successfully restored.

Superfinishing of engineering components at a final stage of production has been known for a number of years. One method of superfinishing is a chemically accelerated vibratory finishing procedure available from REM Chemicals, Inc. The procedure uses an active chemistry such as a mildly acidic phosphate solution which is introduced with the component into a vibratory finishing apparatus together with a quantity of non-abrasive media. The chemistry is capable of forming a relatively soft conversion coating on the metal surface of the component. Vibratory action of the media elements will only remove the coating from asperity peaks, leaving depressed areas of the coating intact. By constantly wetting the metal surface with the active chemistry, the coating will continuously re-form, covering those areas where the bare underlying metal has been freshly exposed, to provide a new layer. If that portion remains higher than the adjacent areas it will continue to be rubbed away until any roughness has been virtually eliminated. A general description of this superfinishing process is provided in commonly owned U.S. Pat. Nos. 4,491,500 4,818,333 and 7,005,080 and U.S. Patent Publication Nos. US 2002-0106978 and US 2002-0088773 each of which is incorporated herein by reference. Application of such a process to surfaces of large sized gears is described in WO2004/108356, the contents of which are also incorporated herein by reference.

Studies have been performed to determine the utility of such processes in the refurbishment of used gears. Based on such studies it has been determined that a beneficial effect may indeed be achieved in removing damage such as foreign object damage (FOD), scoring, micropitting, pitting, spalling, corrosion, and the like. The extent to which components could be refurbished was hitherto determined by the depth of the damage according to an initial inspection of the parts. For gears where the depth of the damage was less than 0.1× the AGMA (American Gear Manufacturers Association) recommended maximum backlash, refurbishment was generally considered possible. For damage exceeding this depth, the part was generally recommended for scrap. Based on this damage assessment, a large proportion of the gears initially assessed were not deemed suitable for refurbishment. Additionally, of those components where refurbishment using superfinishing was carried out, a number of the components were subsequently scrapped after treatment due to the presence of excessive damage that only became apparent on treatment. In these cases, not only was the component scrapped but the time taken to perform a complete refurbishment cycle was also wasted.

Procedures are available for non-destructive testing of metallic components to determine the extent of surface damage. Such procedures including photomicrography and fluorescent penetrant inspection are however highly complex and their performance adds greatly to the overall cost of a refurbishment procedure. It would thus be desirable to have an improved procedure for assessing candidate components for refurbishment that allows more components to be recovered without unnecessarily adding to the overall cost and time per successfully recovered component.

BRIEF SUMMARY OF THE INVENTION

According to a first aspect of the present invention there is provided a method for inspecting and/or refurbishing a used or otherwise damaged component, using a Subtractive Surface Engineering (SSE) process to remove material from worn or damaged critical surfaces of the component, the method comprising: initially performing the process on the component to remove a first quantity of material from the surfaces; inspecting the surface of the component to determine the extent of damage; and subsequently further performing the process to remove a further quantity of material. By carrying out the damage determination only after initially performing the SSE process, it has surprisingly been found that improved accuracy may be achieved in assessing candidates for refurbishment since this method of material removal does not cause surface distortion. In this manner, the number of candidates for receiving the full refurbishment process may be increased and the number of refurbished components subsequently scrapped due to incorrect damage determination is reduced. The additional work of performing the initial process to remove the first quantity of material may be offset by the reduction in scrapped components. Similarly, the possibility of incorrectly returning a component to service due to surface distress after the regrinding or remachining method due to masking the underlying damage during inspection is eliminated when using this SSE process.

In the present context, "initially performing the process" is understood to refer to the fact that this stage is performed prior to removal of any other material from the component itself. This does not exclude that other material on the surface of the component could be removed, including grease, dirt, oxidation, coking, debris impregnation and other coating layers.

Inspection may take place by any conventional method, suitable for determining the extent of the apparent damage. In this context, "extent" is understood to cover any suitable measure of damage, including but not limited to depth, area, roughness etc. In this context, "depth" is understood to be the deepest point normal to the surface; "area" is understood to refer to the area of the damage in the plane of the surface; "apparent" is intended to refer to the fact that the damage is visible from the exterior either to the naked eye or with magnification, with or without marker or fluorescent penetrant. Reference to the fact that damage determination is carried out after initially performing the process is intended to refer to the fact that no initial pre-selection (e.g. scrapping) of components based on surface conditions is carried out prior to performing the SSE process. It will be understood that selection and scrapping of components due to visible macro-scale damage such as broken teeth or bearings may take place at an early stage prior to processing.

A preferred method of inspection is carried out by visually identifying and marking damage such as FOD, wear or micropitting in a well lit area, photographically recording the locations using a measuring instrument such as a ruler, taking direct profilometer measurements across the damage and documenting the extent of damage. Similarly, another preferred method of inspection is the graphite and tape lifting method described by McNiff, B; Musial, W.; Errichello, R.; "Documenting the Progression of Gear Micropitting in the NREL Dynamometer Test Facility"; 2002 Conference Proceedings of the American Wind Energy Association WindPower 2002 Conference, 3-5 Jun. 2002, Portland, Oreg., Washington, D.C.: American Wind Energy Association, 2002; 5 pp., the contents of which are hereby incorporated by reference in their entirety. This graphite and tape lifting method is particularly useful for mapping the locations of the damage for comparison during the repairing phases of the component refurbishment.

In the following, references to SSE processes are intended to refer to planarizing processes capable of simultaneously removing material from the treated surfaces of a metal component in small, substantially uniform, controlled amounts without causing surface distortion. The SSE processes can be carried out singlely or on large quantities of components at one time. Processes falling within the definition of SSE processes include but are not limited to vibratory finishing and chemically accelerated vibratory finishing using non-abrasive media processes, abrasive media processes, drag finishing, spindle deburr machines, centrifugal disc machines, abrasive media tumbling, loose abrasive tumbling, spindle deburr machines, centrifugal disc machines, Abral™ processes and paste based processes. Preferred processes are isotropic in nature and cause substantially no directionally oriented residual traces on the finished surfaces.

By using an SSE process, minimal amounts of material can be removed from at least the worn or damaged critical surfaces safely and cost effectively. Refurbishment of high value used metal components can thus be achieved. Of particular importance to note is that an SSE process removes material without surface distortion and therefore exposes a true picture for inspection of the resulting surface's properties. In particular, once the surface layer of the metal component has been removed, the true extent of micropitting, pitting, scuffing, corrosion or dynamic fatigue cracking can better be determined. In particular it has been found that the presence and/or extent of subsurface damage such as subsurface microcracks may only become aparent and/or measurable after removal of the outer layer via the SSE process. Other processes including machining (grinding, turning), polishing, sand-blasting physically distort the surface. Such surface distortion may actually cover up or exacerbate subsurface damage, making a subsequent damage determination less accurate and possibly returning to service a component that has not been successfully refurbished.

The proposed SSE processes are also believed to be more fail-safe than previously used regrinding or re-machining processes. In particular, they are less susceptible to set-up failure due to incorrect location of a component in the treatment machine. Furthermore, grinding and machining processes can be prone to metallurgical damage known as temper burn. These machining processes usually require a final Nital etch inspection to ensure that temper burn did not ruin the component. The present invention does not require temper burn inspection although it is understood that this may be carried out for other reasons.

According to a preferred embodiment of the invention, the method may comprise: performing SSE for a short time to uncover surface damage; inspecting the surface; determining the extent of surface damage and initially predicting stock removal—if stock removal prediction exceeds geometrical tolerance, component is scrap—if stock removal prediction is within acceptable geometrical tolerance then proceed; performing SSE to uncover sub-surface damage; monitoring component surface to determine extent or presence of sub-surface damage and modify initial stock removal estimate if needed—if stock removal prediction exceeds geometrical tolerance, component is scrap—if stock removal prediction is within acceptable geometrical tolerance, then proceed; continuing SSE to remove the predicted stock removal; finally inspecting the treated surfaces to determine if component is suitable for re-use. In this manner, the progress of the sub-surface damage can be observed as material is removed and a determination can be made as to if and when a component has been satisfactorily refurbished.

In particular, it has been found that an important indicator for the SSE process is not always the overall depth of the damage but the point of maximum surface area of the damage or a point of maximum surface roughness. Initial removal of the surface material may cause the apparent damage to grow in extent. Such masked damage becomes exposed on removal of material. Once it has reached its maximum extent and begins to decrease in area and/or depth and/or roughness, the process may be terminated, even though damage such as residual micropitting or corrosion pitting remains. In this manner, the component may be successfully treated even though the full depth of the damage is greater than could have acceptably been removed without causing the component to become out of tolerance. It is pointed out in this context, that micropitting itself is not necessarily detrimental and can remain stable during prolonged use. Removal of the undercut, masked and unstable metal is believed to leave a generally stablised residual micropit area that will not grow or produce further debris when returned to service. Further information regarding the nature of micropitting and other surface and sub-surface damage is provided by the above incorporated reference by R. L. Errichello According to a further aspect of the invention, for components having damage comprising e.g. micropitting the method may include determining an extent and location of at least certain micropit areas whereby during subsequent stages, the depth, roughness and/or surface area of the micropit areas is monitored and the process is terminated once this has indicated a trend in reduction. This can be determined by noting a point at which a subsequent measurement reveals the extent of damage to be equal to or preferably less than a previously determined extent of damage. According to an important advantage of SSE processes, since the component does not need to be "set-up" or accurately located, it may easily be removed for inspection, if required. Furthermore, since the SSE process is effectively a continuous process, inspection can be repeated as frequently as desired, allowing extremely accurate monitoring of the progress of damage removal. As will be understood, such incremental monitoring is not possible for machining procedures that remove a determined amount of material on each pass. By the use of a profilometer, a caliper, a ruler, a micrometer, a witness coupon, indicator and/or the graphite and tape lifting method, the SSE process can be carried out while ensuring that the component stays within geometrical tolerance based only on general knowledge of the component, such as its quality grade.

According to a still further advantage of the invention, the process may be terminated on the basis of an amount of damage remaining or when the damage has been substantially removed. As a result of accurate monitoring of the damage in terms of both depth and extent, and of the incremental nature of material removal using SSE, the point at which the damage is substantially removed can be precisely determined. In this context, "substantially removed" may be defined on a case-by-case basis according to the desired finish required. It may be chosen as the point, where for e.g. the deepest damage being treated: damage has disappeared entirely; damage depth is less than 5% of its original depth; damage depth is less than 10 micron; damage area is less than 50%, 30% or 10% of its original extent; surface roughness is decreasing; Ra is less than 0.25 micron.

According to a preferred embodiment of the method a thickness of between 0.1 micron and 10 microns of material is removed during the initial SSE process stages. This quantity of material has been found appropriate for revealing the initial extent of actual damage in most cases. It is understood that greater or lesser quantities of material may be removed in subsequent stages in order to further reveal, monitor and remove damage. Calculation of subsequent quantities of material for removal may be based on the inspection after initial processing.

An important aspect of the invention is the monitoring of the amount of material removed. For many SSE processes, a witness coupon of the same or similar material as the component under refurbishment may be used. This is subjected to the same conditions as the component and its reduction in size may be monitored using a micrometer. Such a procedure is however sensitive to certain factors. The witness coupon must be of the same or similar metallurgical composition to the component in order to be consumed at the same rate. Furthermore, because of its distinct geometry, its reduction in size will not be identical to that of the component. Alternatively, for a known procedure, material removal may be based on the processing time. In the case of the preferred process of chemically accelerated vibratory finishing, the operator may know that certain steel grades are consumed at the rate of 1 micron per hour and adjust the process accordingly. Such a process is also subject to error, since, for an unknown component, an estimation of e.g. the steel grade is required and other factors such as corrosion or surface finish may affect the result. According to a preferred aspect of the invention, the procedure may be monitored by means of depth indicators provided on the surface of the component to be processed. These may be grooves, notches, patterns or the like of known depth or geometry whereby removal of a given quantity of material causes the indicator to change or disappear. Such indicators may be provided at one or more locations on the relevant surfaces and may be provided to indicate one depth or a series of depths. The depth indicators may also be in the form of known markings already present on the component e.g. in the case of engineered components, the removal of residual grind lines may be used. Although the depth of such grind lines may vary between components, their use has surprisingly been found convenient since their depth is generally related to the quality and tolerances of the component being refurbished: a high tolerance component may have very fine residual grind lines of 1 micron depth while a lower tolerance component might have grind lines of 10 micron depth. Removal of the grind lines (or other indicators) can easily be ascertained in situ by visual inspection using e.g. 10× magnification. The indicator may also be used to calibrate the process for further material removal. Thus, if 2 microns is removed in 1 hour of processing using chemically accelerated vibratory finishing, an eight hour process could be expected to remove 16 microns.

In an advantageous embodiment of the invention, the method may be carried out on a plurality of used components, whereby after initially performing the process, on inspection, those components are discarded where the extent of damage is greater than a predetermined permissible amount (e.g. where dynamic fatigue cracks are revealed). In this manner, thousands of components can be refurbished at one time in a particularly cost effective manner. By performing the initial procedure on all components and inspecting only after this process, increased efficiency may be achieved and an overall increased recovery rate (i.e. reduced wastage). Most preferably, the plurality of used components may be simultaneously refurbished whereby at least during the SSE process, the components are all subjected to the same process conditions.

According to a further aspect of the invention, for large batches of components, all components may be subjected to SSE processing without initial inspection for a predetermined period of time based on a statistically calculated maximum material quantity to be removed. Thereafter, the parts may be inspected, either individually or on a sample basis and a determination may be made as to whether the parts are accepted or scrapped. In this particular case, no subsequent further processing would be carried out since material removal is initially calculated to achieve the maximum statistically acceptable removal while remaining in geometric tolerance.

For batch processing, the components may be identical or different. Simultaneous processing may thus be carried out on a large number of identical components or a number of different components e.g. all the gears, shafts, bearings etc from a single machine. Because individual set-up is not required, the components may, at least initially, be easily treated together and thus subject to the same process conditions. This may be beneficial e.g. from a quality control perspective since testing of one component for surface finish could be expected to apply equally to another component. This may be applicable in particular where all components are metallurgically similar but may also be applied in cases of dissimilar materials. In certain circumstances, parts of components that are not intended for treatment may be masked or may be masked after partial completion of the procedure.

The SSE process can be carried out via mass finishing equipment such as vibratory bowls and tubs, spindle and drag finishing machines and the like, using abrasive media processes, abrasive compound processes or chemically accelerated vibratory machining processes with abrasive or non-abrasive media. A most preferred procedure is a chemically accelerated vibratory superfinishing process. This process has shown itself to be extremely effective in producing an isotropic finish of extremely low surface roughness (Ra of less than 0.1 micron). Furthermore it has the added advantage that residual corrosion pits may be stabilized since the mild phosphate active chemistry has the ability to convert the ferric oxide to ferric phosphate, thus inhibiting further propagation.

According to an important advantage of the invention, the SSE process is capable of achieving a surface finish Ra of less than 0.25 microns. In this manner, not only is the component refurbished, it also benefits from the known advantages of superfinished ultra-smooth surfaces. This may be achieved in a single procedure at a single facility.

In general, the method may be performed without reference to the component's engineering specification drawing or an equivalent specification sheet. The persons performing the method are thus less bound by limitations that may be imposed by the manufacturer—in particular in circumstances where the ESD may not even be made available to third parties. The same SSE processes and equipment can thus also be used to refurbish geometrically different components economically whether a few in number or many thousands. Most importantly, the procedure needs much less manpower, time and expense for set up and processing than the regrinding or re-machining process and does not cause surface distortion which can mask the surface damage. The process may also be performed without use of component specific tooling, resulting in considerable expense reduction for e.g. one-off jobs. It is however not excluded that certain specific tooling may be required for lifting, supporting, disassembling components etc.

In one embodiment, the invention further relates to an engineering component refurbished according to the method described above. The refurbished component may have an amount of material removed, sufficient to stabilise damage due to e.g. foreign object damage, scoring, micropitting, pitting, spalling, corrosion and the like. The component may in particular be distinguished by the presence of residual stabilized damage.

Most preferably, the component has surfaces finished to a surface roughness Ra of less than 0.25 microns although finishes of less than 0.1 microns or even less than 0.05 microns may also be achieved. Significantly, in the case of larger scale damage such as FOD, the edges or borders of the pits may be planarized by the process without inducing further distress to the region.

The component according to the invention may be any metal engineering component selected from the group consisting of: gears, shafts, bearings, pistons, axles, cams, seats, seals. The invention is also considered to include sets of components e.g. for a single machine, in which each component has been finished by the same process to the same final condition.

In another aspect, the invention relates to a method of inspecting used engineering components for sub-surface damage, using a subtractive surface engineering process to remove material from critical surfaces of the component, the method comprising: performing the process on the components to remove a quantity of material from the surfaces; inspecting the surfaces of the components to determine an extent of apparent damage; and on the basis of the inspection, determining whether the component is suitable for re-use or whether the component should be scrapped. In a simple form of the invention, all components may be processed an amount sufficient to maintain the component within the tolerance required. Determination may then be made on the basis of e.g. an absolute maximum size or depth of residual damage. By following the procedure thus described, without first performing inspection and pre-selection of components on the basis of surface damage, a beneficial increase in efficiency may be achieved for refurbishment, avoiding the costs and inaccuracy of an early decision procedure.

In a preferred embodiment the method may comprise additionally performing at least one further inspection cycle of material removal and inspection before the determination is made. The inspection cycle may be repeated until the extent of the apparent damage has stabilised. For e.g. micropitting, this may comprise determining a size, depth and/or roughness of at least one micropit region and comparing this with an extent determined in a previous cycle. The process may e.g. be terminated when the extent of micropitting is less than that determined in a previous cycle. Alternatively, the process may be terminated at the point at which the damage has been substantially removed. Other features of the method of inspection may be substantially as described above in the context of refurbishment.

BRIEF DESCRIPTION OF THE DRAWINGS

Further features and advantages of the invention will be appreciated upon reference to the following drawings, in which:

FIGS. 1A-D show graphite lift records of a tooth of a wind turbine gear at various stages during its refurbishment according to an embodiment of the invention;

FIGS. 3A, B show profilometer traces across a region of micropitting for a tooth according to a second exemplary embodiment of the invention.

DESCRIPTION OF ILLUSTRATIVE EMBODIMENTS

Example 1

The following is a description of an exemplary embodiment of the invention, carried out on a 52" (130 cm) wind-turbine input stage ring gear as detailed in Table I.

TABLE I

| Component: | |
|---|---|
| Industrial Use | Wind Turbine Gear |
| Gear Description | Ring Gear, Internal |
| Number of Teeth | 86 |
| Gear Size (approximate as measured) | OD-58.5 in. (149 cm), ID-50.25 in. (128 cm), Root Diameter-52.0 in (130 cm), Tooth Height - 1.25 in (31.8 mm), Face Width-12.75 in (32.4 cm). |
| Material | Steel, hardened (through hardened, nitrided or carburized-Unknown) |

The gear was unpacked from shipping material and visually inspected for macro-scale damage such as broken or cracked teeth and significant FOD. For the purpose of the example, surface damage such as FOD, corrosion, micropitting and macropitting were documented with photography, graphite lift and profilometry, using the profilometer according to Table II.

TABLE II

| Profilometer: | |
|---|---|
| Manufacturer | Mahr |
| Model | M4Pi |
| Trace Length (Lt) | 0.06 in./1.5 mm |
| Cut-Off (Lc) | 0.01 in./0.25 mm |
| Filter | Gaussian |
| Variance (Print Scale) | 100 microinches/2.5 microns |

FIG. 1A shows a graphite lift of what is suspected to be micropitting on the flank of a tooth subsequently identified as tooth 1. An arrow indicates the area of damage for profilometer measurement. This area was chosen as an exemplary measurement location due to the severity of the damage and the uniqueness of the damage spot making it easy to find throughout the testing.

Figure 2A:
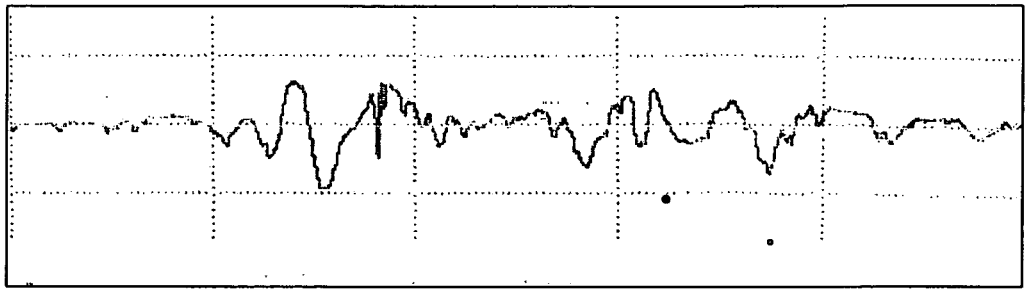
FIGS. 2A-D show profilometer traces across a region of micropitting of the tooth recorded in FIGS. 1A-D.
Figure 2B:
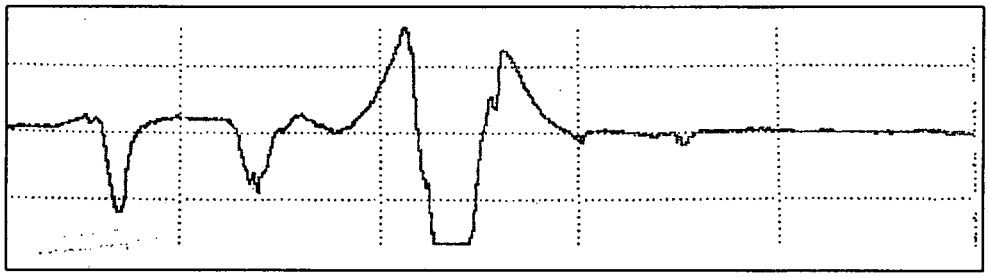

FIG. 2A is the profilometer surface roughness trace across the area of micropitting identified on tooth 1, indicating Ra −18 microinches (0.457 microns), Rmax −158 microinches (4.0 microns) and Rz −90 microinches (2.29 microns). The vertical scale of the trace is 100 microinches (0.25 microns). The results are shown in Table VII below.

The gear was loaded into a vibratory bowl according to Table III filled with the media according to Table IV and supplied with refinement chemistry according to Table V.

TABLE III

| Processing Equipment: | |
|---|---|
| Machine Type | Vibratory Bowl |
| Size | 600 liters |
| Power Setting | 55 HZ |
| Amplitude | 4 mm |
| Angle | 70-80 degree |

TABLE IV

| Media: | |
|---|---|
| Type | Fired ceramic, high density, non-abrasive |
| Trade Name | FERROMIL ® Media #9 |
| Shape | Tricyl |
| Size | ⅜ inch (9 mm) |

TABLE V

| Refinement Chemistry: | |
|---|---|
| Trade Name | FERROMIL ® FML-590 |
| Concentration | 15 v/v % diluted with water |
| Flow Rate | 6 gallons (27 liters) per hour |
| Time | 4 hours |

The machine was started along with the flow of refinement chemistry. The gear was totally submerged under the media and completely wetted with refinement chemistry. The vibratory bowl had a continuous flow of refinement chemistry into it at all times. The vibratory bowl was not fitted with a drain valve such that the refinement chemistry continually drained from three separate slotted drain locations. The gear was processed for one hour of refinement and then removed from the bowl for inspection. The vibratory bowl and refinement chemistry flow were stopped during the inspection. Tooth one was located, cleaned with a damp cloth and dried.

The change in micropitting area on tooth 1 was documented with a graphite lift as shown in FIG. 1B. A reduction in overall micropitting area and reduction in residual grinding lines imparted during the gear's original manufacturing were observed. The surface roughness Ra, Rmax and Rz was documented by profilometry at the same location as during the initial inspection as indicated by the arrow in FIG. 1B. The gear was also visually inspected in a well lit area to ascertain if more damage was revealed after the initial processing. During this inspection a large amount of FOD damage to the majority of the teeth was noted. Major FOD damage was seen during the macro damage inspection, but its full extent was made more obvious after the initial processing and inspection. The profilometer readings indicated that the surface roughness had increased after the initial processing period to Ra −29 microinches (0.737 microns), Rmax −427 microinches (10.8 microns) and Rz −154 microinches (3.91 microns). This increase in surface roughness (Ra, Rmax and Rz) is an indication that there was "surface distortion" which masked the true depth of the damage seen on the surface.

The gear was then processed for another one hour of refinement and removed for inspection. The vibratory bowl and refinement chemistry flow were stopped during the inspection. Tooth 1 was located, cleaned with a damp cloth and dried. The reduction in micropitting area on tooth 1 was documented with a graphite lift as shown in FIG. 1C, which shows a reduction in micropitting area. It can also be seen that the residual grinding lines imparted during the gears original manufacturing have been substantially removed.

Figure 2C:
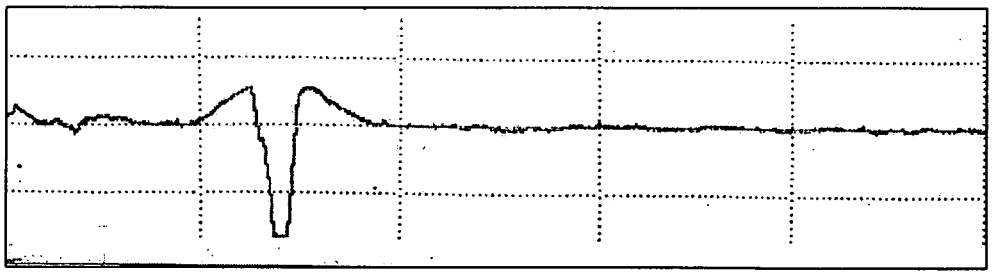

The surface roughness Ra, Rmax and Rz was documented by profilometry at the same location as during the initial inspection. FIG. 2C is the surface roughness trace across the area of micropitting identified on tooth 1 during the initial inspection. It indicates values for Ra −11 microinches (0.279 microns); Rmax −282 microinches (7.16 microns); and Rz −71 microinches (1.80 microns). It is noted that the surface roughness has now decreased from the value measured after the first hour of processing.

The gear was subsequently processed for two more hours of refinement and then removed for inspection. The vibratory bowl and refinement chemistry flow were stopped during the inspection. Tooth 1 was located, cleaned with a damp cloth and dried. The change in micropitting area on tooth 1 was documented with a graphite lift as shown in FIG. 1D. It can now be seen that the extent of damage has been significantly reduced and the grind lines completely removed.

Figure 2D:
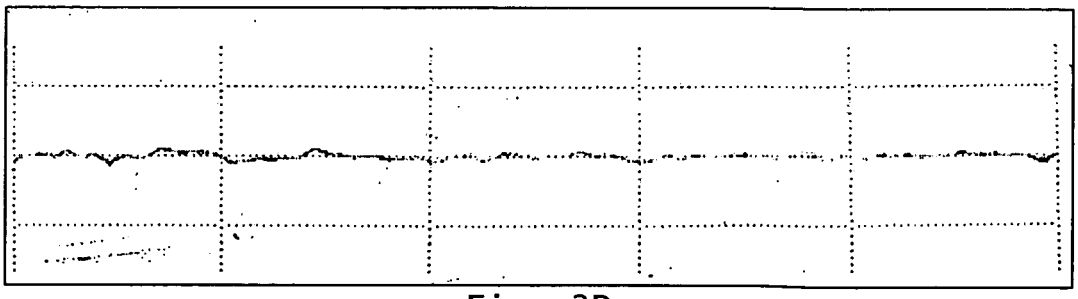

The surface roughness (Ra, Rmax and Rz) was documented by profilometry at the same location as during the initial inspection. FIG. 2D is the surface roughness trace across the area of micropitting identified on tooth 1 during the initial inspection. It indicates values for Ra −3 microinches (0.076 microns); Rmax −23 microinches (0.58 microns); and Rz −17 microinches (0.43 microns). It is noted that the surface roughness has decreased during the extended process to a value significantly below the initial values.

The gear was deemed refurbished after the 4 hr inspection on the basis of a steadily decreasing roughness and area of residual surface damage and a value of Ra below 12 microinches (0.3 microns). The residual surface damage remaining was small in individual area and widely spaced such that a significant stabilized surface area remained in-between the residual damage. Furthermore, all grind lines imparted during the original manufacturing were removed from the tooth flanks. No new damage was observed upon completion of the process however, the residual damage is evident through visual and graphite lift inspection.

The gear was placed back in the vibratory bowl for the burnishing stage of the process using the burnish chemistry of Table VI.

TABLE VI

| Burnish Chemistry: | |
|---|---|
| Trade Name | FERROMIL ® FBC-295 |
| Concentration | 1 v/v % diluted with water |
| Flow Rate | 50 gallons per hour (225 l/h) |
| Time | 1.5 hours |

The refinement chemistry was stopped. Burnish chemistry was introduced into the bowl to flush the refinement chemistry from the bowl and remove the conversion coating that was formed during the refinement stage from the gear surfaces. The gear was burnished for 1.5 hours and deemed complete. Final visual inspection indicated that a small amount of residual damage remained on tooth 1 after the process. On the basis of previous measurements, it is estimated that not more than 400 microinches (10 micron) of stock was removed from each tooth flank during the 4 hours of processing.

According to the results as disclosed in Table VII, it can be seen that the roughness values of the measured surface increased after initial processing for one hour. After a further hour of processing, these values were once more of similar magnitude to the original regions. After 4 hours of processing a marked reduction in the roughness could be observed and the overall extent of the damage was significantly reduced.

TABLE VII

| Roughness Values: | | | | |
|---|---|---|---|---|
| | Initial Condition | 1 hour | 2 hour | 4 hour |
| Ra (microns) | 0.457 | 0.737 | 0.279 | 0.076 |
| Rmax (microns) | 4.00 | 10.8 | 7.16 | 0.58 |
| Rz (microns) | 2.29 | 3.91 | 1.80 | 0.43 |

Qualitative assessment or the parts also indicated that the overall extent of the damage was significantly reduced.

Example 2

A second large input stage planetary gear according to Table VIII was processed.

TABLE VIII

| Component: | |
|---|---|
| Industrial Use | Wind Turbine Gear |
| Gear Description | Sun Pinion |
| Number of Teeth | 16 |
| Type of Gear | Helical |
| Material | Steel, hardened (nitrided or carburized-Unknown) |

The gear was unpacked from shipping material and visually inspected for macro-scale damage. Surface damage such as FOD and micropitting were documented with photography, profilometry and graphite lift techniques. FIG. 3A is the surface roughness trace across an area of micropitting using the profilometer according to Table IX with a vertical scale of 10 microns.

TABLE IX

| Profilometer: | |
|---|---|
| Manufacturer | Hommel |
| Model | T1000 |
| Trace Lenght (Lt) | 1.50 mm |
| Cut-Off (Lc) | 0.250 mm |
| Filter | ISO 11562 (M1) |

According to the initial inspection surface roughness values of Ra −0.68 micron, Rmax −7.63 micron and Rz −4.02 micron were recorded.

The gear was loaded into the vibratory tub according to Table X containing media according to Table V above.

TABLE X

| Processing Equipment: | |
|---|---|
| Machine Type | Vibratory Tub |
| Size | 1200 lites |
| Power Setting | 55 HZ |
| Amplitude | 4 mm |
| Angle | NA |

The machine was started along with the flow of refinement chemistry as indicated in Table IV above but at a slightly higher flow rate of 32 liters/hour. The gear was totally submerged under the media and completely wetted with refinement chemistry. The gear was processed for six hours of refinement and a maximum of approximately 15 microns removed based on prior knowledge of the approximate material removal rate for corresponding new components. The gear was periodically inspected. Inspection consisted of stopping the tub and refinement chemistry, moving the media away from a few teeth and visually assessing the progress of damage removal. Upon reaching the maximum time/material removal allowed, the refinement chemistry flow was stopped and burnish chemistry flow was immediately started using the burnish chemistry of Table VI. The gear was burnished for 3 hours and deemed complete.

Surface damage such as FOD and micropitting were documented with photography, profilometry and graphite lift techniques. FIG. 3B is the surface roughness trace across an area of micropitting at a vertical scale of 1 micron. It indicates values of Ra −0.07 micron, Rmax −0.94 micron and Rz −0.61 micron. Final visual inspection indicated residual micropitting remaining on the teeth after the process. Graphite lift results showed that the area of micropitting was not significantly reduced, but the profilometer measurement indicated that the depth was significantly reduced. Visual monitoring of the component during the process indicated that damage was stable and no new damage was observed. The area of residual surface damage had a value of Ra below 0.3 microns. The gear was processed in the refinement cycle for the stated amount of time in order to ensure all grind lines imparted during the original manufacturing were removed from the tooth flanks. Based on these observations, the part was deemed refurbished.

In the interest of clarity, not all possible implementations of the methods of the present invention are described herein. It is appreciated that during the development and implementation of actual embodiment of the methods, numerous implementation-specific decisions may be made to achieve specific goals, such as compliance with system-related and business-related constraints, which will vary from one implementation to another. Moreover, it will be appreciated that such development efforts might be complex and time-consuming, but would nevertheless be a routine undertaking for those of ordinary skill in the art having the benefit of this disclosure.

Further modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A method of inspecting an engineering component for subsurface damage without performing grinding, using a chemically accelerated vibratory process to remove material from worn or damaged critically dimensioned surfaces of the component, the component being a gear, shaft, bearing, piston, axle, cam, seat or seal, the method comprising:

a) disassembling the component if necessary to fully expose the worn or damaged critically dimensioned surfaces of the component;

b) performing the chemically accelerated vibratory process on the component to remove a quantity of material from the surfaces;

c) inspecting the surfaces of the component to determine an extent of apparent damage; and d) on the basis of the inspection, determining whether:

i. the component can be reused; or ii. the component should be scrapped.

2. The method according to claim 1, comprising performing at least one further inspection cycle whereby for each further inspection cycle at least steps ab), bc) and cd) are repeated.

3. The method according to claim 1, wherein the inspection cycle is repeated until the extent of the apparent damage has stabilised.

4. The method according to claim 3, wherein the damage comprises micropitting, step b) comprises determining an extent of at least one micropit region and step c) comprises comparing the extent of the micropit region with an extent determined in a previous cycle.

5. The method according to claim 3, wherein the process is terminated when the extent of the micropit region is less than that determined in a previous cycle.

6. The method according to claim 1, wherein the process is terminated when the damage has been substantially removed.

7. The method according to claim 1, wherein during step b), a thickness of between 0.1 micron and 10 microns of material is removed.

8. The method according to claim 1, for inspecting a plurality of used components, whereby step b) is performed simultaneously for all components.

9. The method according to claim 1, wherein the process to remove material from the surfaces is performed to achieve a surface finish Ra of less than 25 microns.

10. The method according to claim 1 performed without reference to the component's engineering specification drawing or an equivalent specification sheet.

11. The method according to claim 1, wherein the process is performed without use of component specific tooling.

12. The method according to claim 1, further comprising providing an indicator on a surface to be treated and inspecting the indicator to determine a quantity of material removed.

13. The method according to claim 1, wherein the surface of the component is comprised of steel.

14. The method of claim 1, wherein the chemically accelerated vibratory process uses acid-based active chemistry.

15. A method for refurbishing an engineering component without performing grinding, using a chemically accelerated vibratory process to remove material from worn or damaged critically dimensioned surfaces of the component, the component being a gear, shaft, bearing, piston, axle, cam, seat or seal, the method comprising:

a) initially performing the chemically accelerated vibratory process on the component to remove a first quantity of material from the surfaces, wherein the chemically accelerated vibratory process uses acid-based active chemistry;

b) inspecting the surface of the component to determine an extent of damage; and c) subsequently further performing the chemically accelerated vibratory process to remove a further quantity of material.

16. The method according to claim 15, further comprising the repetition of steps b) and c).

17. The method according to claim 16, wherein steps b) and c) are repeated until the extent of the damage has stabilised.

18. The method according to claim 16, wherein the damage comprises micropitting and step b) determines an extent of at least certain micropit regions whereby during subsequent steps b) and c), the extent of the micropit regions is monitored and the process is terminated once the extent of the micropit regions has stabilised.

19. The method according to claim 15, wherein the process is terminated when the damage has been substantially removed.

20. The method according to 15, wherein during step a), a thickness of between 0.1 micron and 10 microns of material is removed.

21. The method according to claim 15, for refurbishing a plurality of used components, whereby after initially performing the process, those components are discarded where the extent of damage is greater than a predetermined amount.

22. The method according to claim 15, for simultaneously refurbishing a plurality of used components, whereby at least during step c), the components are all subjected to the same process conditions.

23. The method according to claim 15, wherein the process is performed to achieve a surface finish Ra of less than 0.25 microns over the surfaces.

24. The method according to claim 15, performed without reference to the component's engineering specification drawing or an equivalent specification sheet.

25. The method according to claim 15, wherein the process is performed without use of component specific tooling.

26. The method according to claim 15 further comprising providing an indicator on a surface to be treated and inspecting the indicator to determine a quantity of material removed.

27. The method according to claim 15, wherein the surface of the component is comprised of steel.

28. The method of claim 15, further comprising, prior to step a), disassembling the component if necessary to fully expose the worn or damaged critically dimensioned surfaces of the component.

* * * * *